US006007429A

United States Patent [19]

Lubniewski

[11] Patent Number: 6,007,429

[45] Date of Patent: Dec. 28, 1999

[54] ELECTRONIC TARGET GAME APPARATUS AND METHOD

[76] Inventor: Michael E. Lubniewski, 93 Lafayette Ave., Milltown, N.J. 08850

[21] Appl. No.: 08/890,658

[22] Filed: Jul. 9, 1997

[51] Int. Cl.[6] ..... F41J 5/02

[52] U.S. Cl. ..... 463/50; 463/5; 273/371; 273/378; 273/379

[58] Field of Search ..... 463/2–7, 31, 37.38, 463/50, 52, 53, 54, 49, 51; 473/569–571; 273/371–379, 317, 454, 460; 434/21, 23, 20; 250/206, 215

[56] References Cited

U.S. PATENT DOCUMENTS

| | | | |
|---|---|---|---|
| 4,083,560 | 4/1978 | Kikuchi et al | 463/5 |
| 4,192,507 | 3/1980 | Rains et al. | 463/50 |
| 4,257,612 | 3/1981 | Villa | 463/5 |
| 4,266,776 | 5/1981 | Goldfarb | 273/310 |
| 4,533,144 | 8/1985 | Juarez et al. | 463/5 |
| 4,545,583 | 10/1985 | Pearman et al. | 463/5 |
| 4,898,391 | 2/1990 | Kelly et al. | 463/5 |
| 5,775,998 | 7/1998 | Ikematsu et al. | 463/52 |
| 5,785,592 | 7/1998 | Jacobsen | 463/7 |

*Primary Examiner*—Michael O'Neill
*Assistant Examiner*—John M Hotaling, II
*Attorney, Agent, or Firm*—Arthur L. Pevy

[57] ABSTRACT

There is disclosed an electronic game apparatus comprising a plurality of player positions wherein each contestant is assigned a given player position, each position, each position having an equal number of target areas on a display by which each of the contestants proceeds from a first target area to a last target area, wherein the first contestant who activates all of the target areas in the shortest time interval wins, each target area having a light sensitive portion and a visual display portion, the light sensitive portion responsive to a user-controlled light emitting means for aiming and firing a light beam at the light sensitive portion to activate the target area, wherein the visual display portion is activated in response thereto to produce an illuminated pattern indicative of target activation.

21 Claims, 13 Drawing Sheets

FRONT VIEW OF GAME CONFIGURATION

SIDE VIEW OF PLAYER CONFIGURATION

FRONT VIEW FIG. 3A

SIDE VIEW FIG. 3B

SIDE VIEW OF JOYSTICK HOUSING ASSEMBLY

REAR VIEW OF JOYSTICK HOUSING ASSEMBLY

TARGET ASSEMBLY
ELECTRONIC CIRCUITRY

SIX TARGET AREA DISPLAY

LED TARGET PATTERN
COLOR ARRANGEMENT

FIG. 9
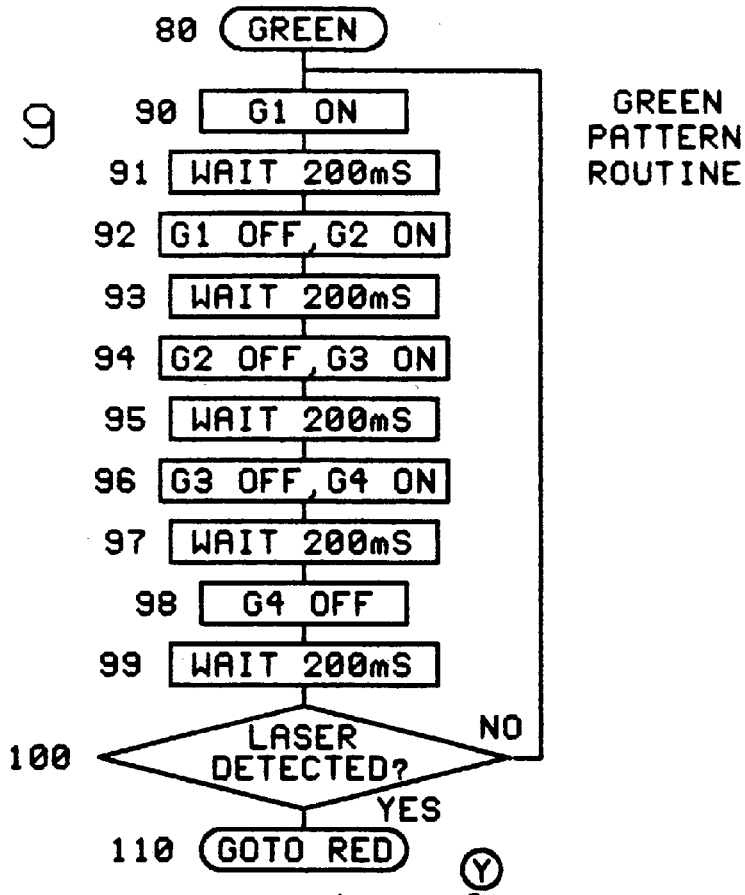
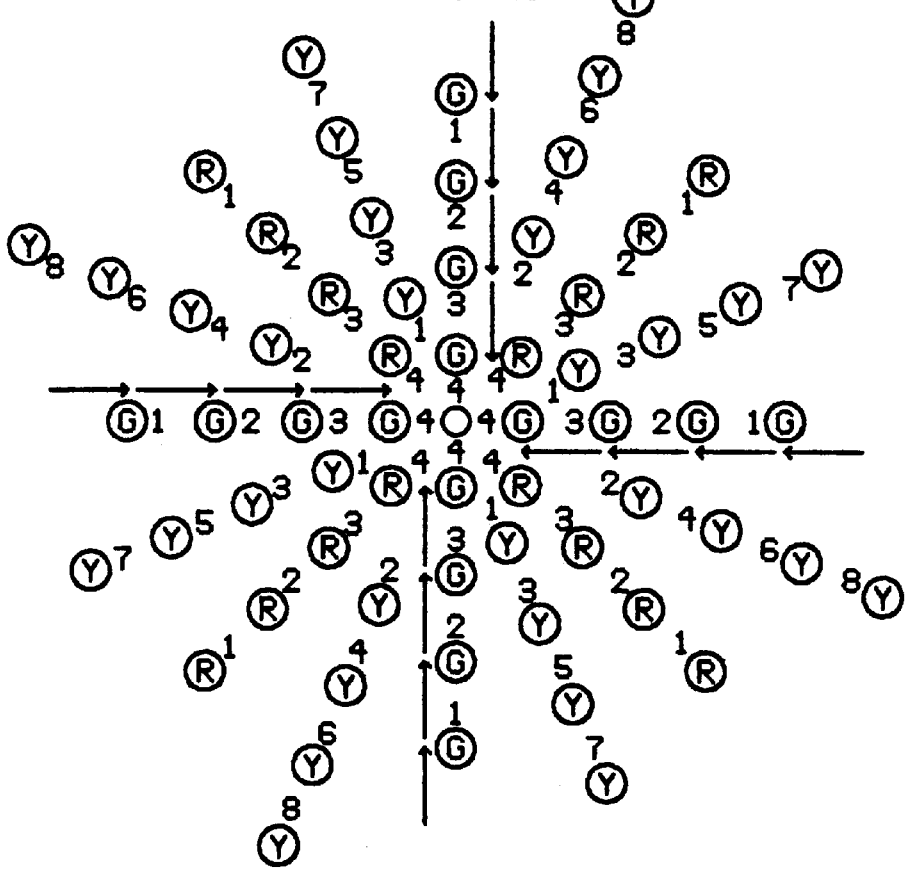

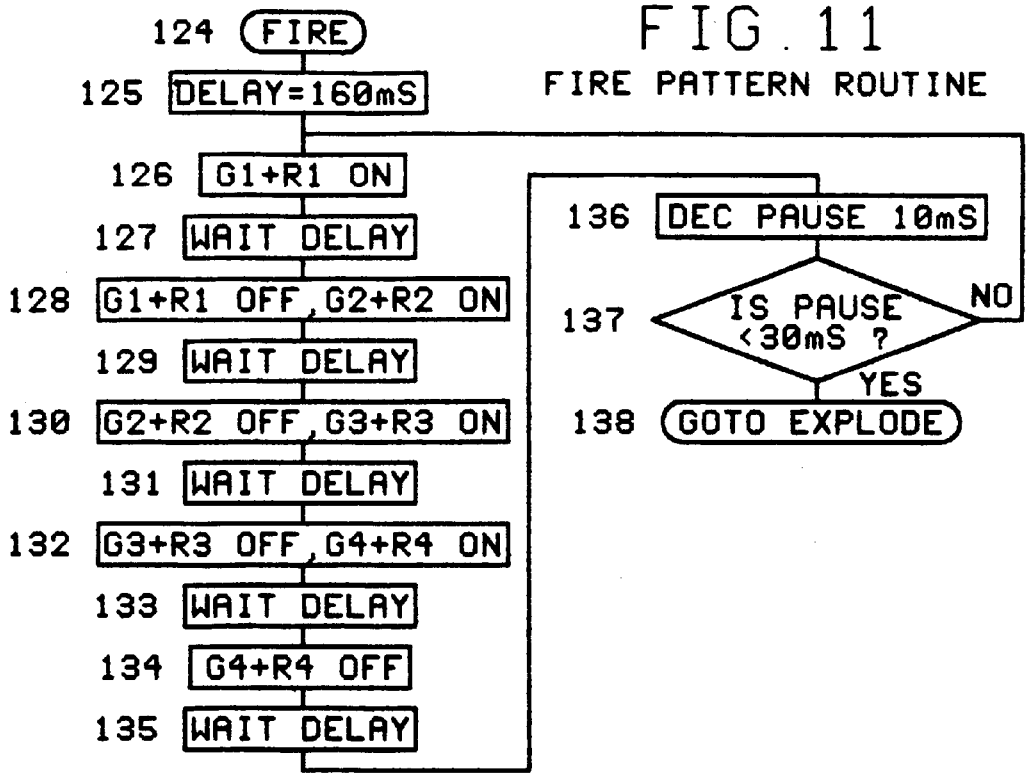
FIG. 11
FIRE PATTERN ROUTINE
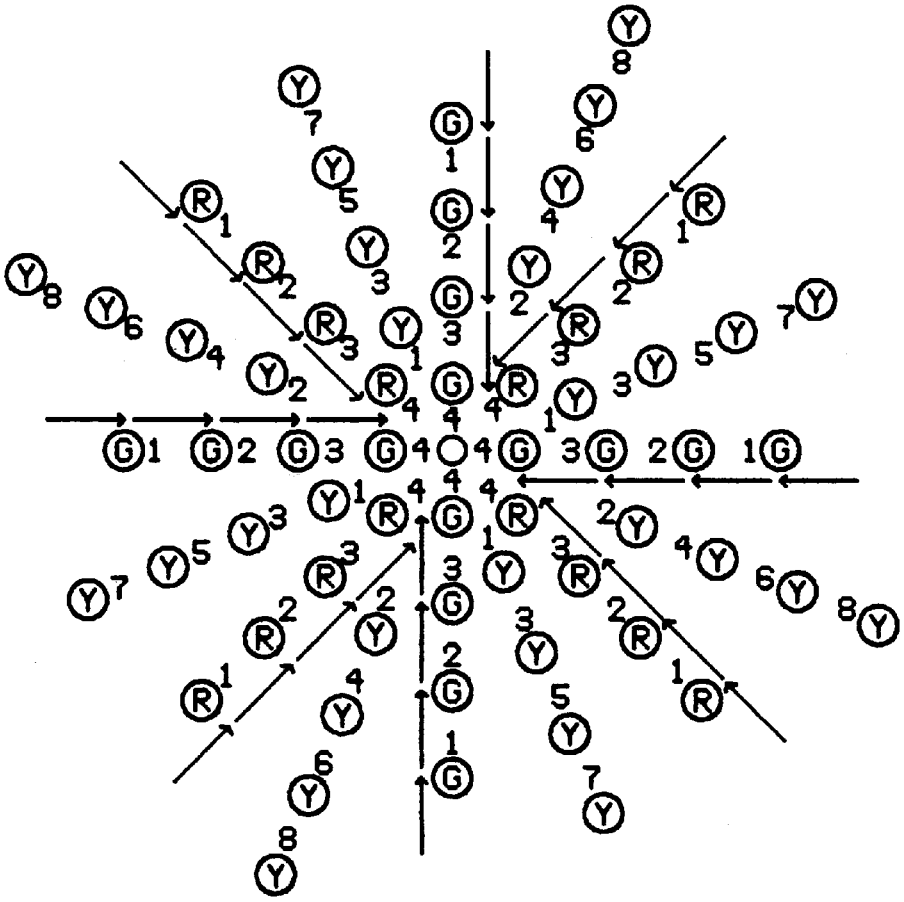

FIG. 12 EXPLODE PATTERN ROUTINE

ELECTRONIC TARGET GAME APPARATUS AND METHOD

FIELD OF THE INVENTION

The invention relates to electronic games in general and more particularly to an electronic laser target and racing game wherein participants engage a series of illuminating targets to become the first to activate all targets in the series.

BACKGROUND OF THE INVENTION

Generally, the prior art is aware of numerous types of racing and shooting games which rely on speed and accuracy to determine a winner. Prior art such as U.S. Pat. No. 5,566,950 issued on Oct. 22, 1996 to R. Senna entitled URINAL ARCADE GAME shows a water gun based game where contestants shoot a water gun into a replica urinal to become the first person to obtain a given water level in the simulated urinal and where a win display of lights and sounds is then provided to notify a winner. U.S. Pat. No. 5,366,229 issued on Nov. 22, 1994 to K. Suzuki entitled SHOOTING GAME MACHINE describes shooting a target projected onto a screen via a mirror using a light beam, photographing the screen with a video camera, and determining the x-y position coordinates to determine if the target has been hit. As one can see by the above and other patents, there are many structures in the prior art which pertain in general to racing and target apparatus. As one can ascertain from the above patents, however, the prior art devices are either relatively simple and do not disclose a sequential light-based target system, or are complicated and difficult to construct, employing camera devices and screen projections for determining target hits. As one can ascertain, it is a requirement the device serves to amuse the users of such device while presenting a reasonable display to enable the user to participate according to the nature of the display. Such devices may be employed for example at amusement parks, carnivals and other areas where games of chance and skill are employed in general.

It is therefore an object of the present invention to provide a light-based sequential target racing game which also utilizes unique display characteristics which operate to attract participants and to enable such participants to the apparatus and to enable such participants to operate the apparatus after the start of the race.

SUMMARY OF THE INVENTION

It is an object of the present invention to provide an electronic game apparatus comprising a plurality of player positions wherein each contestant is assigned a given player position, each position, each position having an equal number of target areas on a display by which each of the contestants proceeds from a first target area to a last target area, wherein the first contestant who activates all of the target areas in the shortest time interval wins, each target area having a light sensitive portion and a visual display portion, the light sensitive portion responsive to a user-controlled light emitting means for aiming and firing a light beam at the light sensitive portion to activate the target area, wherein the visual display portion is activated in response thereto to produce an illuminated pattern indicative of target activation.

BRIEF DESCRIPTION OF THE DRAWINGS

The invention is to be explained in more detail below based on embodiments depicted in the following figures where:

FIG. 9 is a flowchart and LED target pattern depicting a green illumination routine for the electronic racing game apparatus of the present invention.

FIG. 11 is a flowchart and LED target pattern depicting a fire routine for sequentially illuminating LEDs of the electronic racing game apparatus of the present invention.

DETAILED DESCRIPTION OF THE INVENTION

Figure 1:
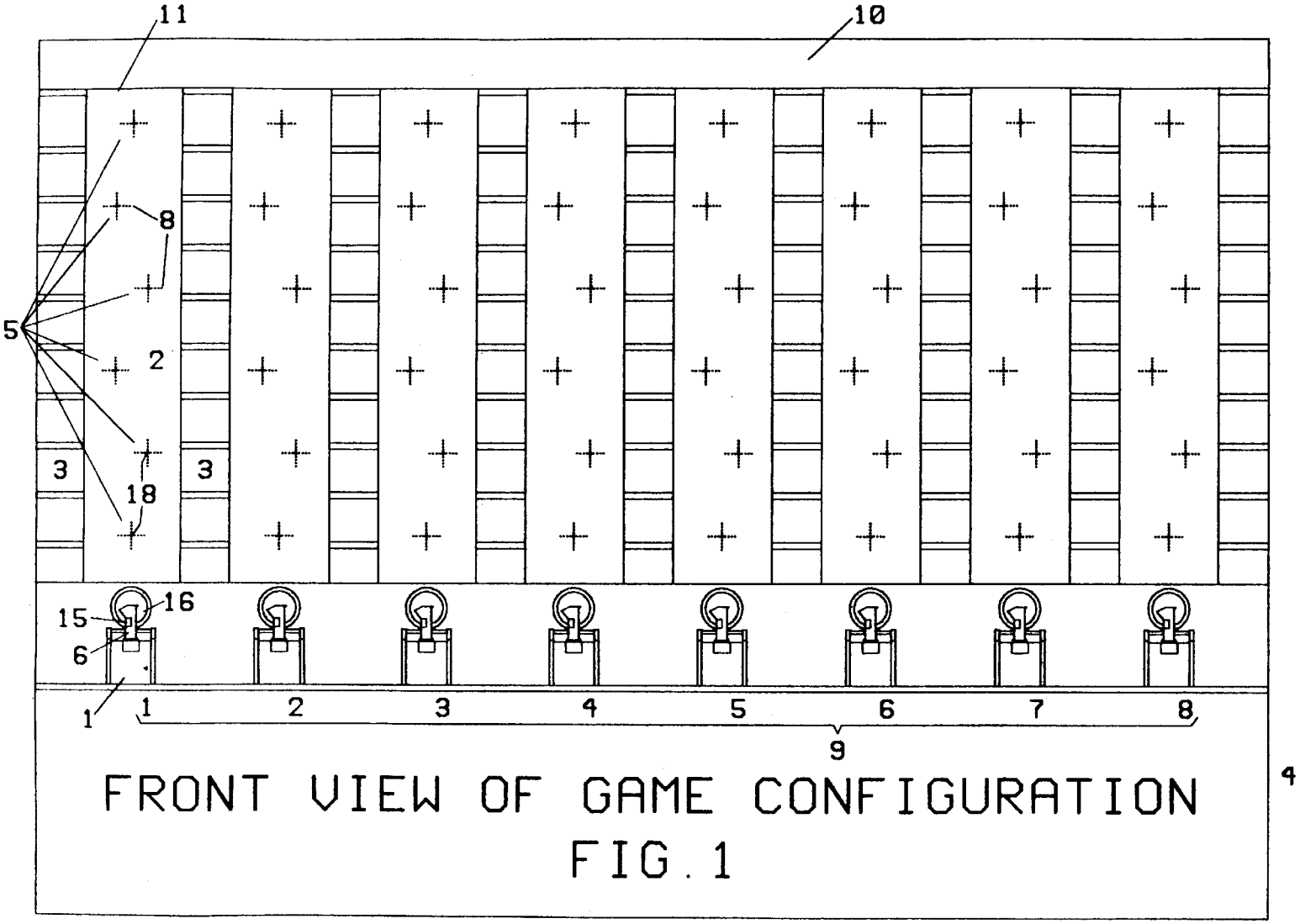
FIG. 1 is an exemplary diagram depicting a front view of the electronic racing game apparatus configuration according to this invention.
Figure 2:
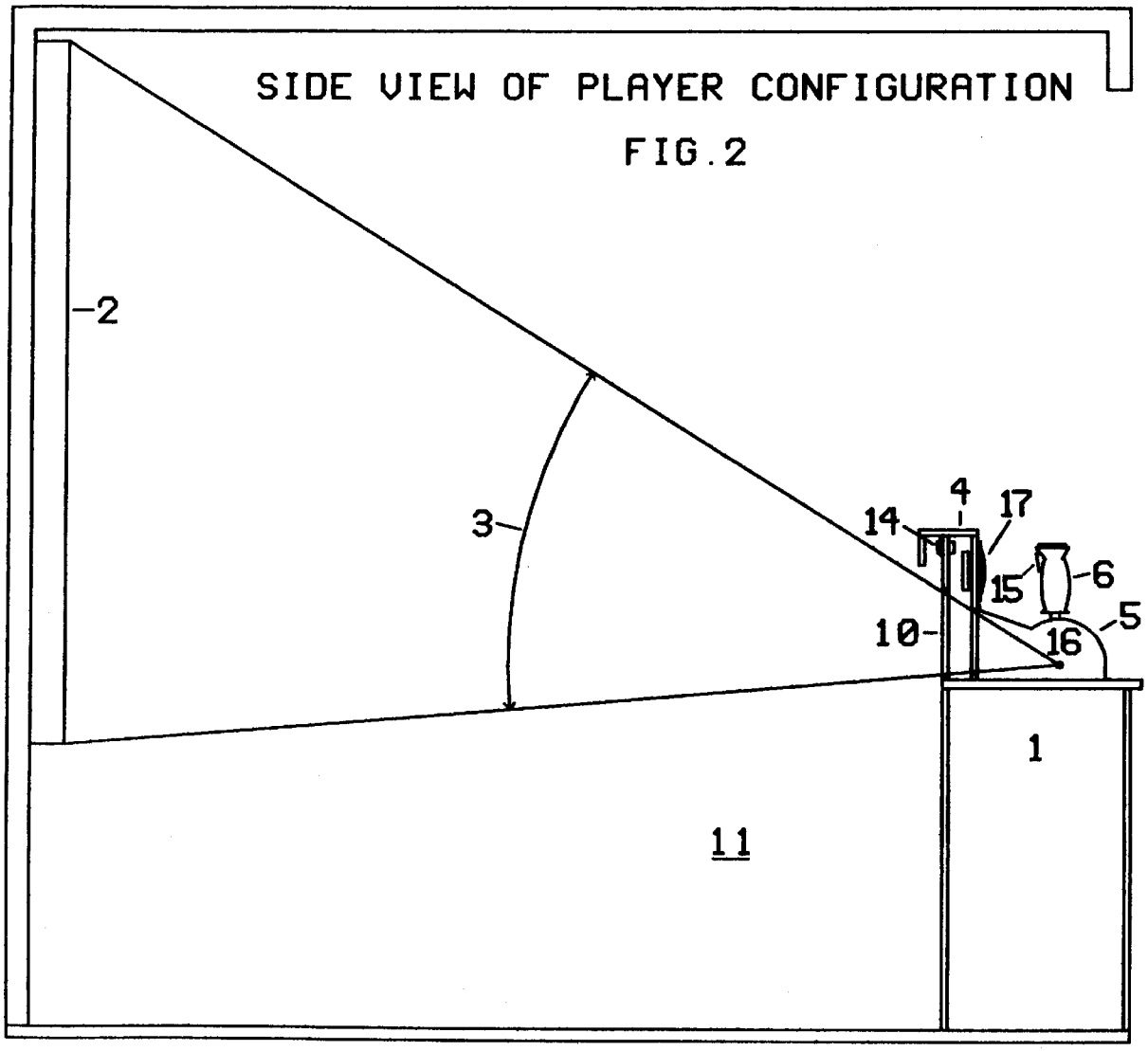
FIG. 2 is an exemplary diagram depicting a side view of a player configuration according to the present invention.

Referring to FIG. 1, there is shown a front view of an embodiment of the game configuration 10 of the present invention. The game components include, for each of the player positions 1–8 shown in FIG. 1 (reference numeral 9), a laser console 1 which includes a joystick-operated conventional laser diode 16, and a target assembly 11 which includes a target display 2 having six target areas 5 at which the laser diode is aimed and subsequently "fired". In this arrangement, each player of the game is an independent modular unit having control over his/her own laser console 1 and target display 2 for aiming and "firing" at each of the target areas, while having no control over any other players' lasers or targets. The target displays 2 are separated from one another by spacers 3. In a preferred embodiment, these spacers may be shelves on which to display prizes. In the preferred embodiment, each laser console 1 also includes a speaker 17 for providing sound effects and a hidden player enable button 14 which is accessible only to the operator as shown in FIG. 2, which illustrates a side of a player configuration. The handle of the joystick 6 contains a trigger switch 15. Referring back to FIG. 1, each target area 5 comprises a light sensing element 18 such as a photo transistor located preferably at the center of each target area and a visual display portion consisting of a plurality of visual display indicators 8 such as light emitting diodes (LEDs) sequentially arranged in a pattern around the photo transistor 7. The target assembly 11 further includes electronic circuitry (not shown) for providing the electronic interface between the laser 16 and the target areas 5 and for electronically controlling the overall operation of the game. In the preferred embodiment, the target assembly 11 consists essentially of a shallow box for housing the electronic circuitry, including the circuit connections for the photo transistor 7 and LEDs 8, with the target display 2 covering the interior of the box. Preferably, the target display 2 comprises a planar surface having a plurality of apertures or cutouts for receiving each of the LEDs 8 and photo transistors 7 comprising the target areas. The target display 2 preferably consists of a durable reflective black plastic material (approximately ⅛ in. thick) cutout or other material which covers the electronic circuitry and provides a contrasting background for the laser light and the visual display indicators to enable the participant to easily view and aim the laser beam at each of the target areas. In the preferred embodiment, each target assembly is mounted on a wall directly in front of the laser console 1 in view of the respective player.

As shown in FIG. 2, the range of movement of the laser beam 3 is mechanically restricted by the joystick 6 to only the height and width of the player's target display 2. An aperture 10 through which the laser light must pass also restricts the laser beam to the target area, further reducing the chance of exposure to the beam. The backsplash 4 houses the speaker 8 and player enable button 9, but functions primarily to prevent the player from coming into contact with the laser. The backsplash also prevents access by the player to the player enable button 9. The joystick handle 6 with its trigger switch 15 provides all necessary player input during a game. The laser joystick housing assembly 5 connected to the joystick 6 also serves the dual purpose of protecting the laser 16 and mechanical workings of the joystick from dirt and exposure while shielding the player from any laser exposure. A game operator area 11 allows an operator passage behind the player consoles to acknowledge participants and enable active players of the game. The area is not used by operators during play. An operator's booth (not shown) containing the operator start button may be provided at either side of the group of players, out of range of the lasers. As one can ascertain, FIG. 1 shows how eight players can be connected together to create an eight player game. Any number of players may be grouped together since each player is a self contained unit. As shown, the target displays 2 and hence, target areas 5 are in direct sight of their respective player consoles 1.

The laser joystick 6 and housing assembly 5 shown in FIG. 2 operate to control the movement of the laser diode to the area within the target display while at the same time protectively enclosing the diode, thus protecting the contestants and onlookers from exposure to the laser light.

Figure 3:
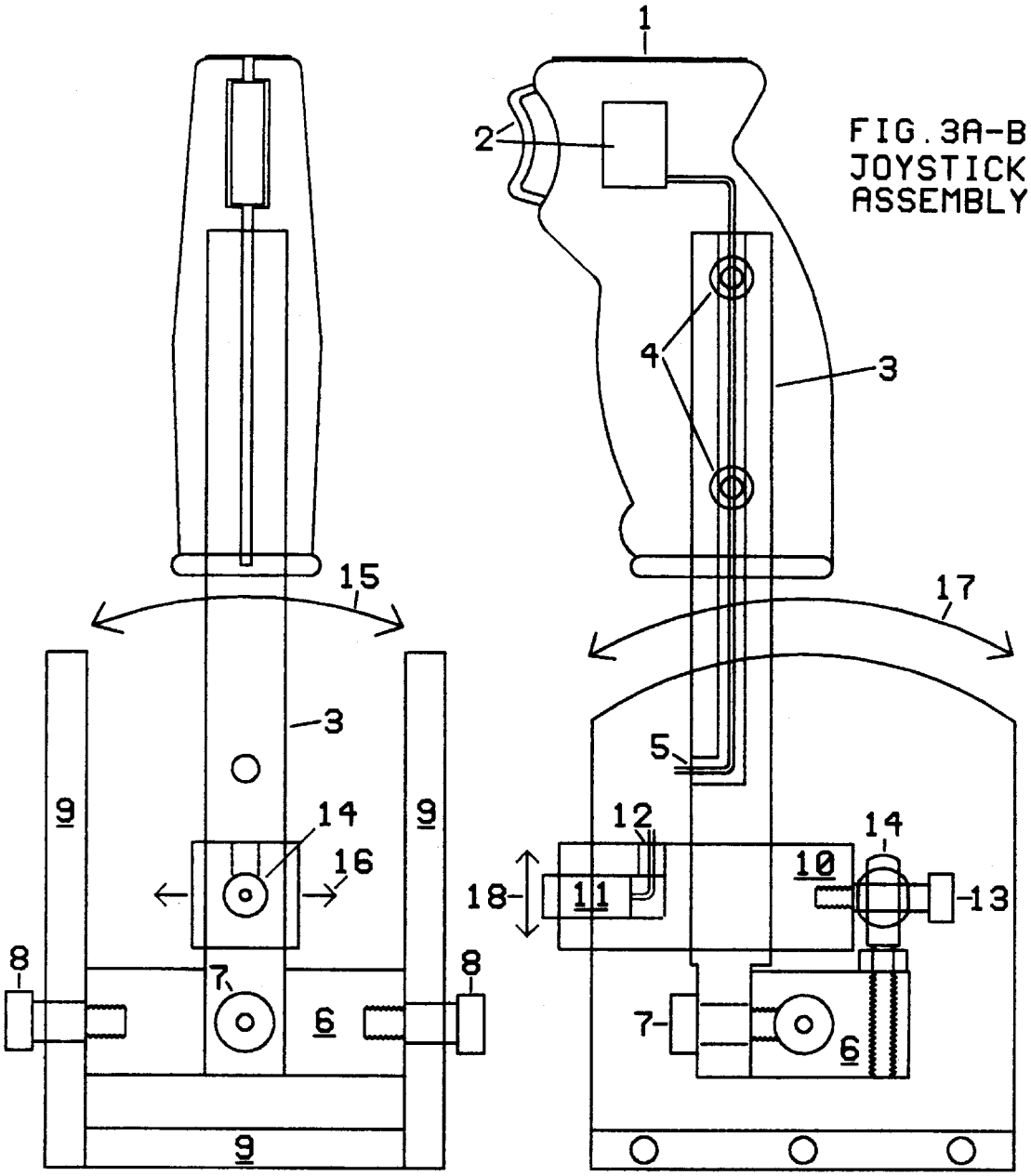
FIGS. 3A and 3B depict front and side views of the laser joystick assembly according to the present invention.

FIGS. 3A and 3B offer a front and side view, respectively, of the mechanical laser joystick assembly. The grip assembly (1) houses a trigger switch (2) and is secured to the handle shaft (3) with screws (4). The trigger wires (5) are routed down through the center of the shaft (3) into the joystick housing. The shaft is attached to the axle (6) by a shoulder bolt (7) which allows the handle side to side movement on the bolt's axis. The axle (6) is supported by two shoulder bolts (8) through the cradle assembly (9) creating a second pivot point allowing fore and aft movement of the handle. The turret (10) is the part which holds and manipulates the laser diode (11). The laser's wires are routed through a hole in the turret (12) and into the joystick housing. The turret rides on the shaft (3) via a bore on it's center. A spherical rod end (14) is attached to the axle (6), incorporating a shoulder bolt (13) to allow a pivoting support for the turret (10).

Looking at the front view FIG. 3A, when the handle is moved side to side (15), the turret will move likewise (16) rotating on the shaft (3) and pivot on the spherical rod end (14). This offers side to side control of the laser beam. In side view FIG. 3B, fore and aft movement of the handle (17) pivots the entire shaft/turret/axle assembly on the shoulder bolts 8 (FIG. 3A), tilting the turret up and down. This offers vertical control of the laser beam.

Figure 4:
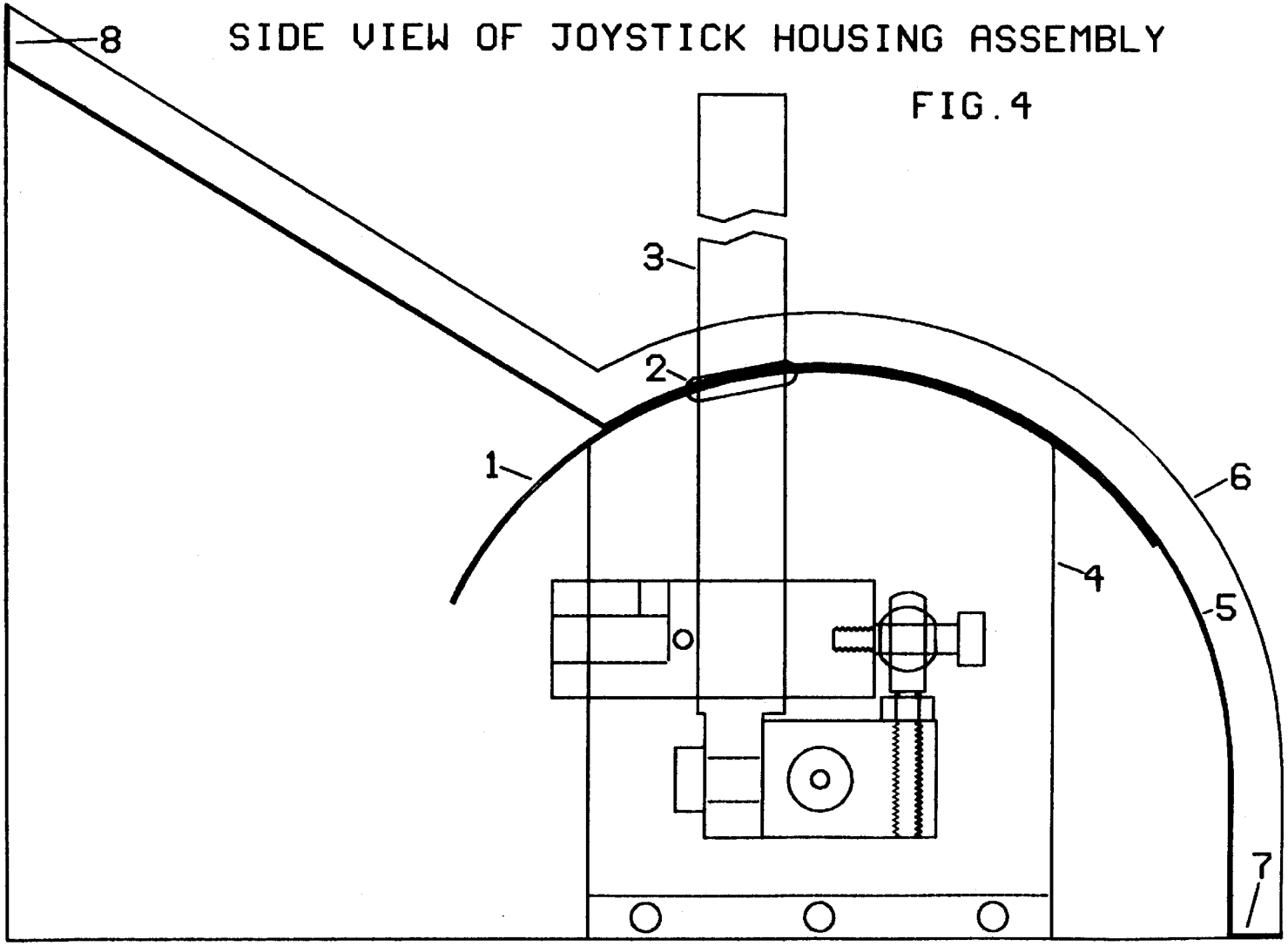
FIG. 4 depicts a side view of the joystick housing assembly according to the present invention.
Figure 5:
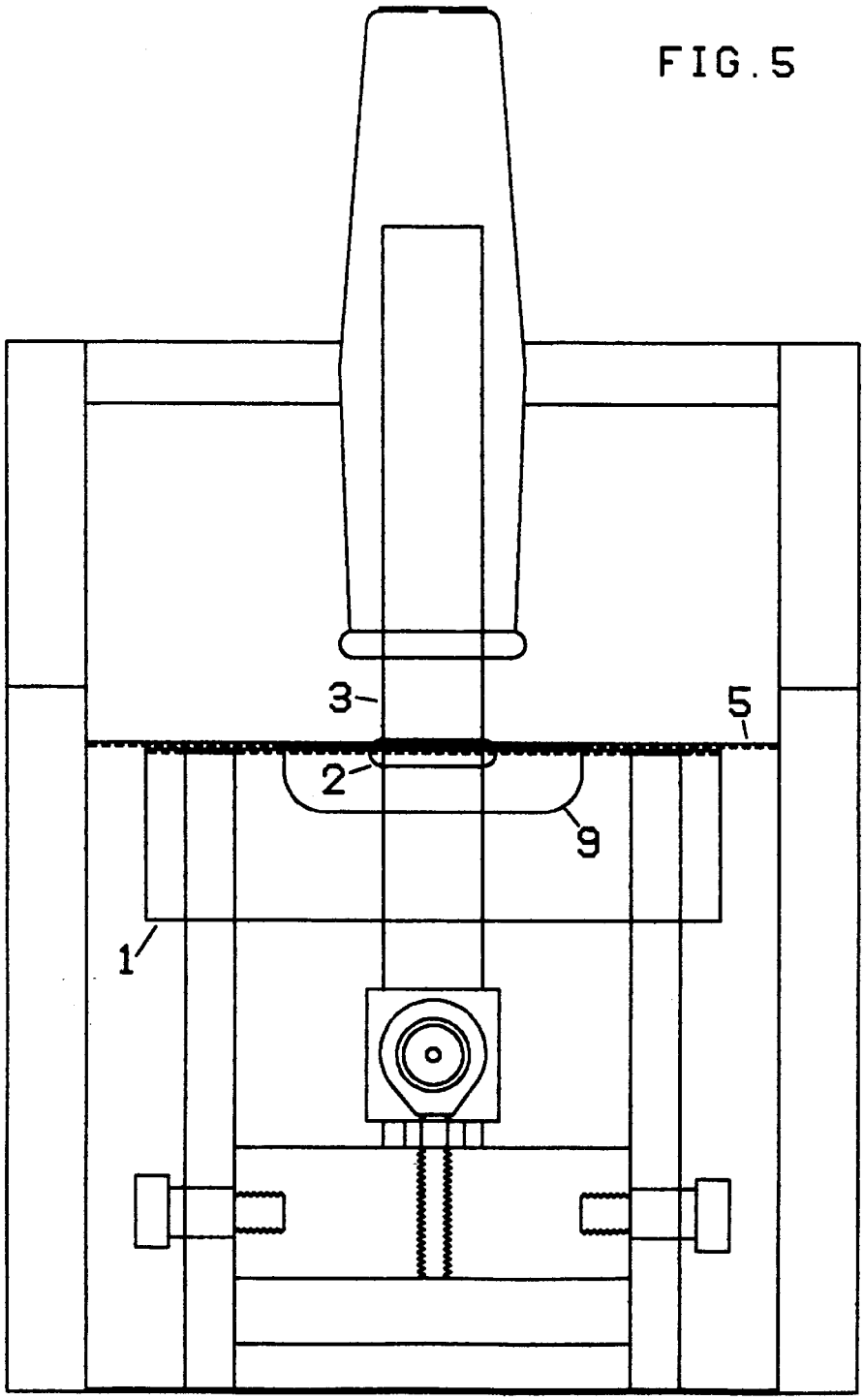
FIG. 5 depicts a rear view of the joystick housing assembly according to the present invention.

FIGS. 4 and 5 represent side and rear views, respectively, of the laser joystick and housing assembly. In FIG. 4, one can see a side view of how the joystick assembly is situated in the housing. A curved sliding shutter 1 is fit over the shaft 3 with a rubber bushing 2. This curved shutter rides on the cradle 4 and beneath the enclosure cover 5. The cover 5 rests recessed between the enclosure sides 6 attaching at the bottom 7 and the top 8. Referring to FIG. 5, the cover 5 has a window 9 which provides an opening for the shaft 3. This window is sealed by the sliding shutter 1 and bushing 2 protecting the laser assembly while still permitting 360 degrees of movement of the shaft 3.

Figure 6:
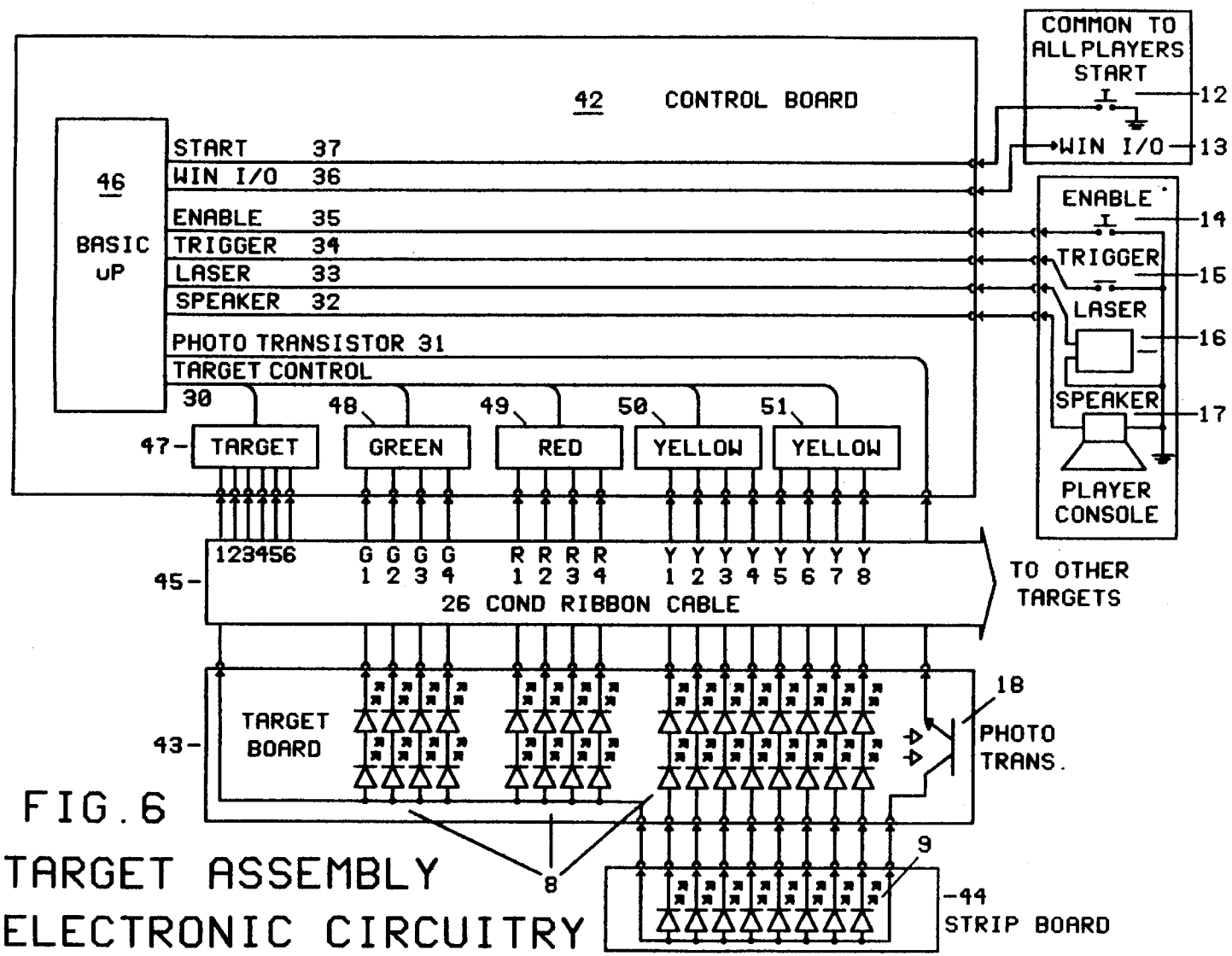
FIG. 6 shows the target assembly electronic circuitry according to the present invention.
Figure 7:
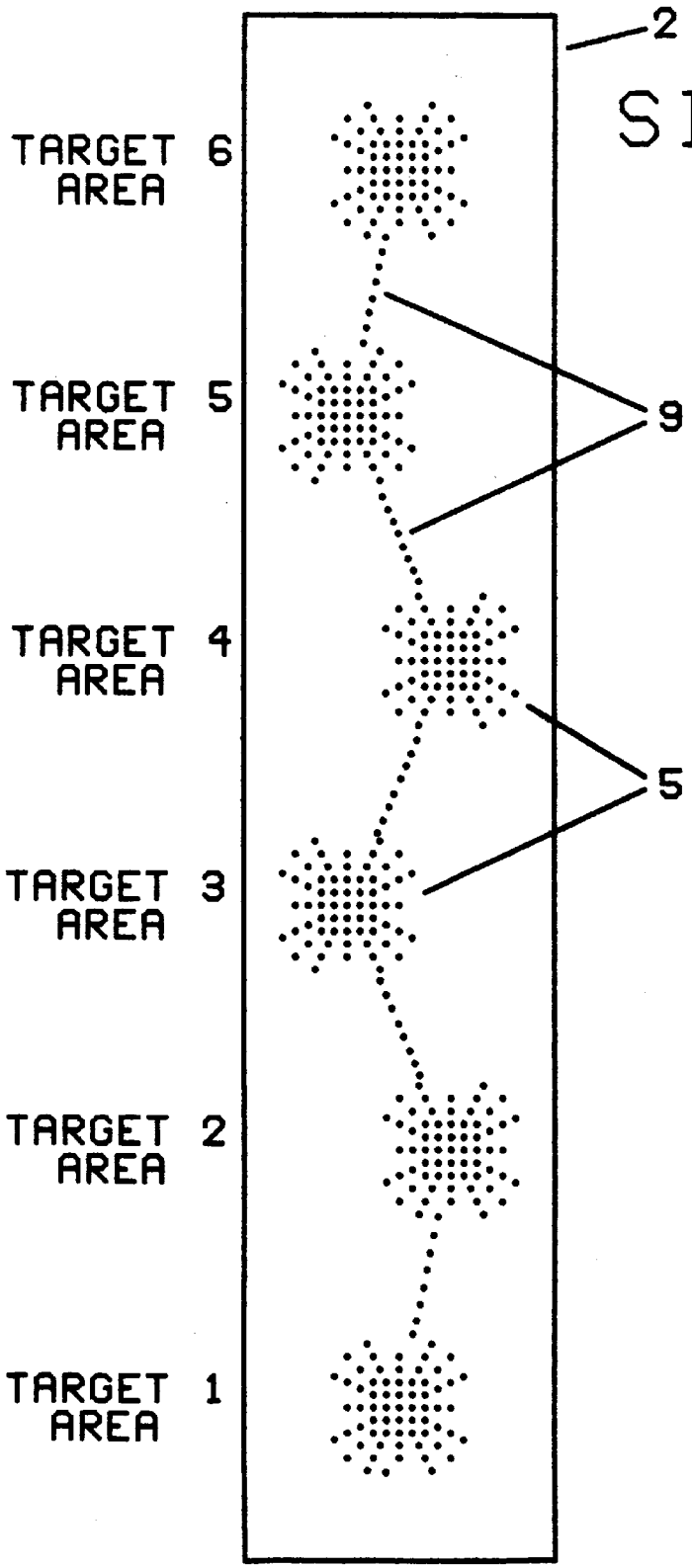
FIG. 7 shows a front view of a six target area display according to the present invention.

As previously indicated in FIGS. 1 and 2, the joystick-operated laser diode 6 is used to aim and fire at each of the target areas 5 sequentially enabled on target display 2 via the electronic circuitry for controlling game operation. FIG. 6 shows a preferred embodiment of the target assembly 11 electronic circuitry. Like reference numerals have been used to designate parts having the same functions as in FIGS. 1 and 2. Referring to FIG. 6, the target assembly 11 for each player contains a control board 42, six target boards 43 (one shown) and five strip boards 44 (one shown) interconnected via pluggable ribbon cables 45. The target boards 43 contain the star patterned LEDs 8 and photo transistors 18 for detecting the laser 16 while the strip boards 44 contain the strip of LEDs 9 between the targets. FIG. 7 illustrates a six target area display configuration 2 showing the pattern of LEDs 9 formed between the star patterned LEDs 8 comprising each target area.

Referring again to FIG. 6, the control board 42 utilizes a basic controller or microprocessor 46 well known in the art as a means of control logic wherein an array of six positive drivers 47 and sixteen negative drivers (reference numerals 48–51) function to illuminate the LEDs on the target and strip boards. In the preferred embodiment, PS2502-XNEC darlington opto-transistors are used for the positive drivers while common TTL 7475 latches are utilized for the negative drivers. A series of input/outputs 8 are provided for microprocessor 46 for interfacing the operator start button 12, win I/O handshake signal 13, player enable button 14, joystick trigger switch 15, laser diode 16, speaker 17, and photo transistor detectors 18.

Figure 8:
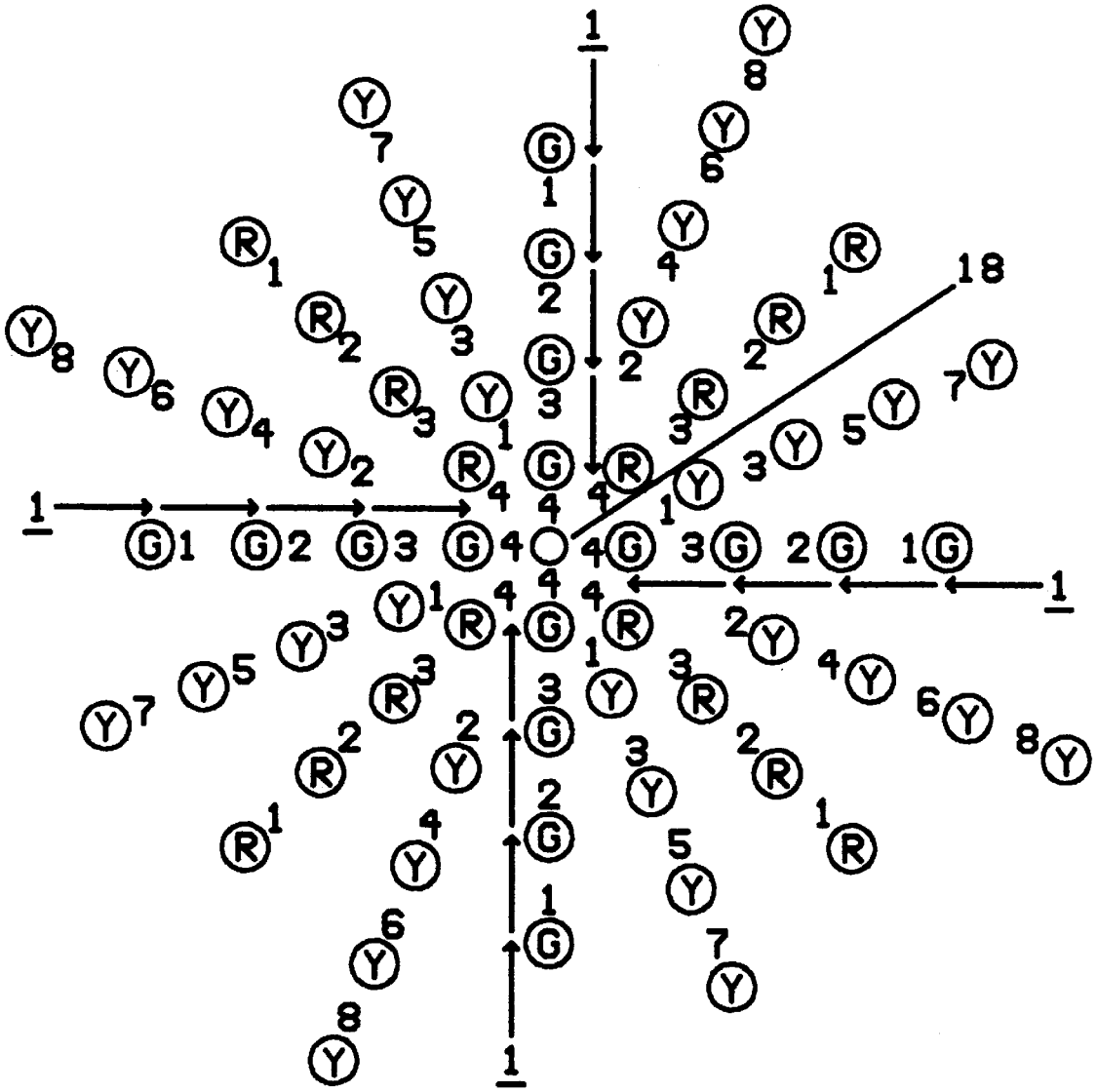
FIG. 8 depicts the LED target pattern color arrangement according to the present invention.

The target boards 43 and strip boards 44 are connected and operated by the control board 42 as common anode devices. There are four green LED circuits G1–G4, four red LED circuits R1–R4, and eight yellow LED circuits Y1–Y8 which also drive the eight green LEDs G1–G8 on the strip boards 44. FIGS. 7 and 8 illustrate how each of these LED colors and circuits are arranged in a pattern to form each of the six target areas. As can be seen in the preferred embodiment, a starlike pattern is formed from the radial alignment of sequential groups of same color LEDs (i.e. R4, R3, R2, R1; G4, G3, G2, G1; Y1, Y3, Y5, Y7) extending outward from the center of the target area. FIG. 7 illustrates how the six targets are positioned along with the green strip LEDs 9 to form the target display 2.

The basic controller or microprocessor 46 operates the LEDs by first selecting a target area by sourcing a positive voltage via one of the six positive drivers 47 over target control line 30. Then utilizing the sixteen negative drivers 48–51, the controller sinks or grounds the particular green, red, or yellow circuits to be illuminated by transmitting additional target control signals over line 30. Referring to FIGS. 6 and 8, if the microprocessor 46 sequentially activates circuits G1, G2, G3, and G4 causing each of the respective LEDs to illumninate, one can visualize a green pattern moving towards the center of the target area in FIG. 4. This example demonstrates the ease by which the microprocessor 46 can create moving light patterns during a game. The microprocessor and circuit are configured such that only the selected target area will be illuminated as a result of selecting one of the six positive target select drivers in module 47; other target areas are not affected. The same holds true for the photo transistors 18 whose collectors are also in electrical communication with target select driver module 47 to receive signal input for target enablement; thus, only the photo transistor associated with the selected target area will respond to the laser 16 and be able to send a positive going signal back to the microprocessor.

The operator start button 12, player enable button 14, and joystick trigger switch 15 are connected as sinking inputs or low=true signals to the microprocessor. The photo transistor 18 input over line 31 is a sourcing or a high=true signal that indicates that the target area has been acquired. The laser diode 16 is turned on by a high discrete output signal from the microprocessor over line 33. The speaker 17 is operated by a single discreet output from microprocessor 46 over line 32. The microprocessor outputs varying frequencies and sound effects stored in memory via this one output without the need for additional sound devices.

As can be seen in FIG. 6, the operator start button 12 and the win I/O signal 13 are the only two signals which are connected common to all players in the game. The operator start button is connected to all control boards 42 in the game which guarantees all players receive the start signal 12 simultaneously. The win I/O signal 13 is jumpered between every game connecting all control boards together. This signal is the only form of interactive communication between players. Before and during a game all AS control board microprocessors treat this signal as an input which is normally high. All microprocessors during a game continuously sample this input for an active low. When the first player activates their sixth (i.e. last) target, that player's control board microprocessor immediately samples line 36 one last time for an active low win I/O signal. If the signal is still high, the microprocessor on that player's control board changes its win I/O from an input to an output, thereby making the signal low. In response, all other players' control boards, upon sampling their win I/O line 36, now detect an active low signal on the win I/O and go into a "lose" mode, wherein the microprocessor 46 disables player control, thereby preventing further game action.

In the preferred embodiment, the object of the game is to be the first player to activate the sequence of star-like LED targets. The player who activates all of the targets first is the winner. In explaining the operation, reference is made to FIGS. 1, 2 and 6. When the game is initially energized, and during idle times between games, a silent display mode is enabled. In silent display mode, a repetitive offset or illumination pattern stored in microprocessor 46 memory is retrieved and executed to repetitively illuminate different groups of visual display indicators 8, preferably LEDs, for each target display 2. The pattern starts at the first (i.e. bottom) target area and proceeds through a green, then red and green, then yellow LED sequence with a trail of green LEDs sequentially illuminated and leading to the next target area as shown in FIGS. 9–12, respectively. This sequence, which actually simulates a game being played, continues to the last (i.e. top) target area of target display 2 (FIG. 2) and then returns to the bottom and repeats continuously until a player is enabled for the next game.

Referring now to FIGS. 2 and 6, a player is enabled for the game when an operator (not shown) presses an enable button 14 preferably located behind the chosen player's console 1 such that the button is accessible only to the operator. In response, an enable signal is transmitted over line 35 to microprocessor 46 causing the silent display mode for that player to be interrupted. Microprocessor 46 then transmits target control signals over line 30 to modules 47 and 48 and speaker signals over line 32 to speaker 17, causing green LEDs G1–G4 to activate to display a first green flashing pattern at the bottom target area, accompanied by a momentary sound effect. This player, having its bottom target area flashing green as shown in FIG. 9, is now ready to start a game and awaits the operator start signal 12. The operator then repeats this procedure to enable all active players to participate in the game. Players which are not active or enabled prior to a game remain in silent display mode (i.e. non-racing mode) and are not affected nor have any effect on the outcome of the game in play.

Figure 12:
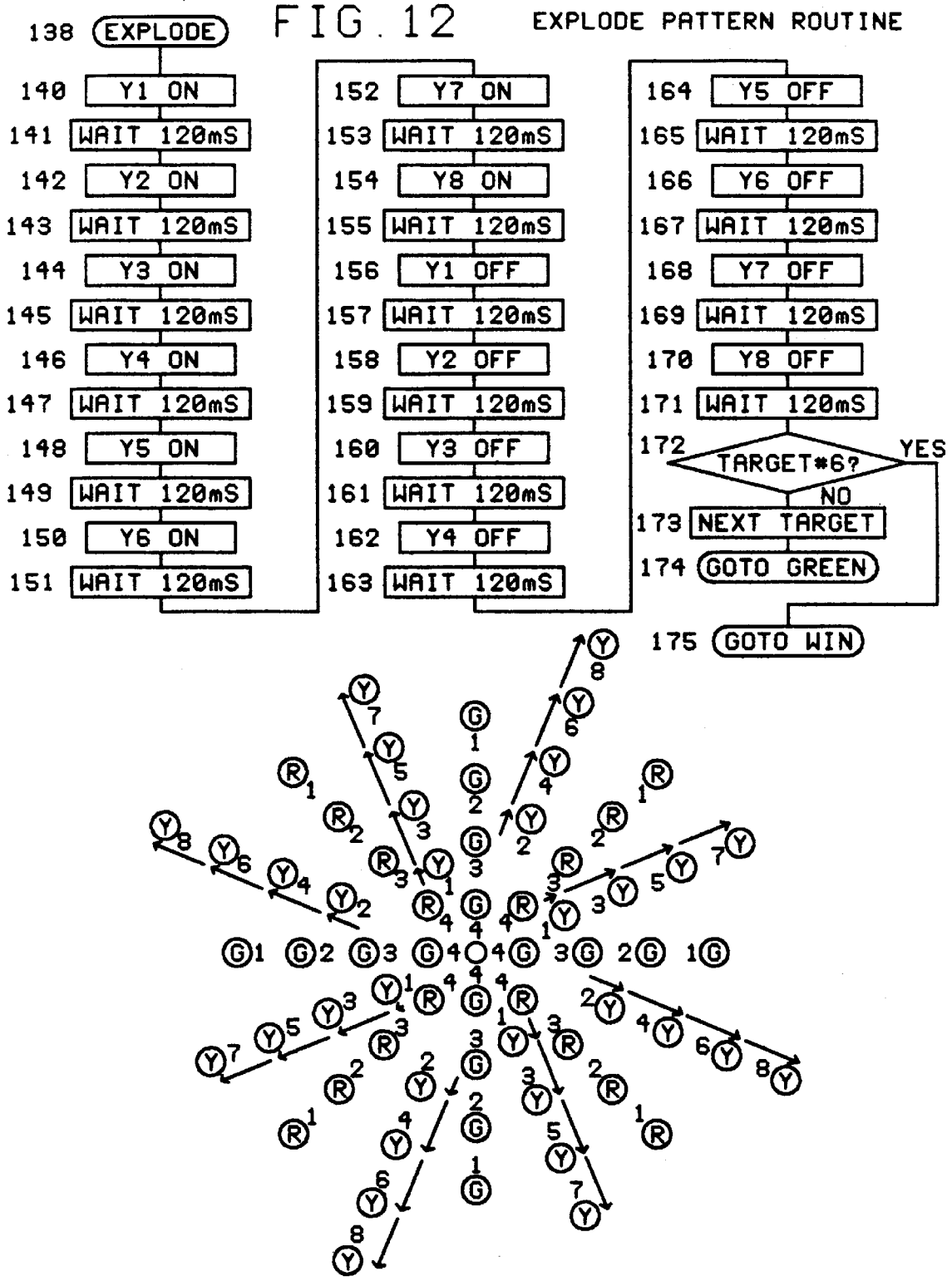
FIG. 12 is a flowchart and LED target pattern depicting an explode routine for sequentially illuminating LEDs of the electronic racing game apparatus of the present invention.
Figure 13:
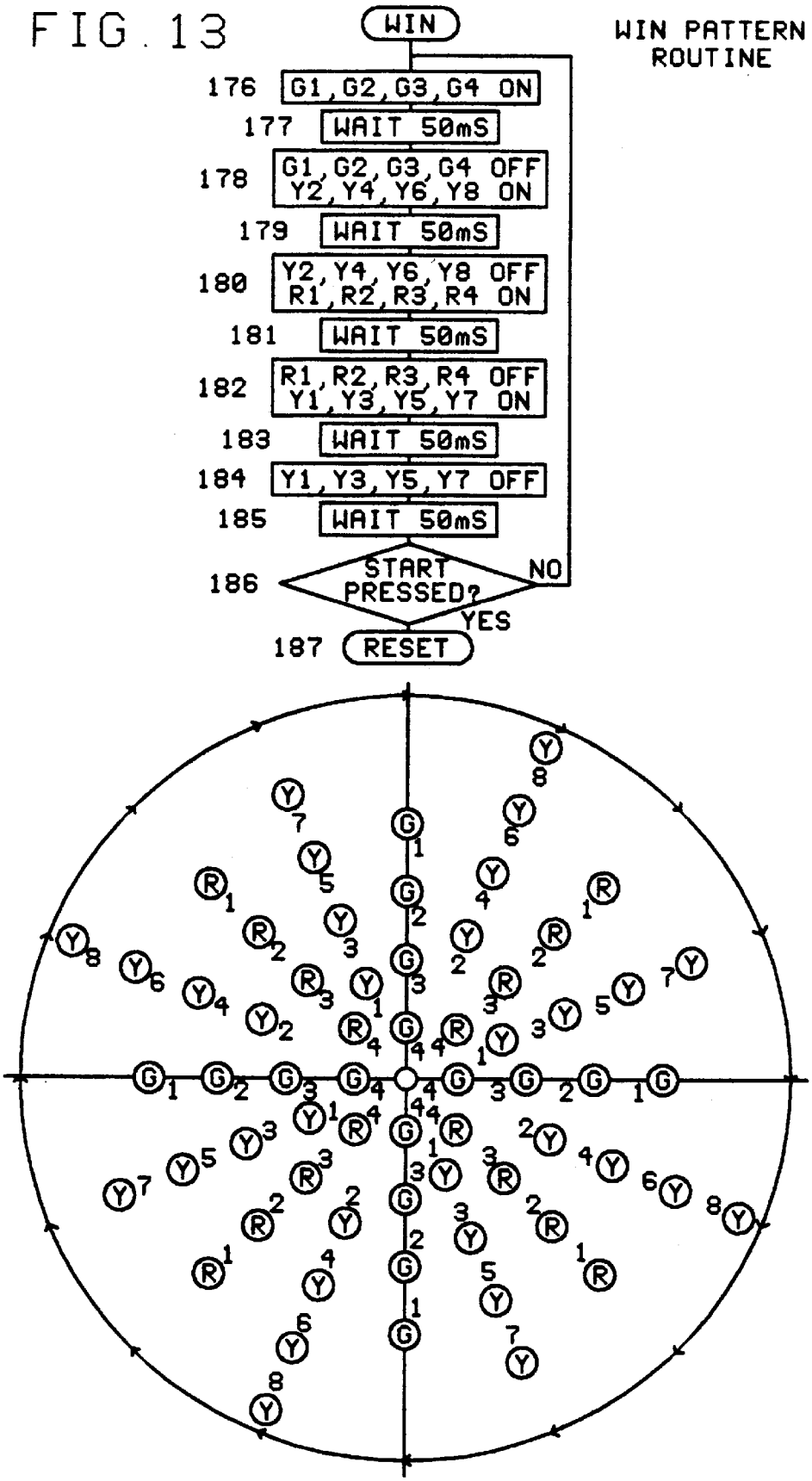
FIG. 13 is a flowchart and LED target pattern depicting a win routine for illuminating LEDs of the electronic racing game apparatus of the present invention.

After all players have been enabled, the operator then depresses operator start button 12 which causes the microprocessor 46 to activate the laser diode 16 for each player and initiates the play or "race" mode. The microprocessor also permits signal reception from the photo transistor 18 associated with the first target area 5 over line 31 which provides photo detection of the laser. Immediately after the laser is activated, sound effects are emitted from speaker 17 and the bottom target area 5 of target display 2 (FIG. 1) continues to flash green. When a player aims the laser at the center of the enabled target area, i.e., the light sensitive photo transistor portion 18, the laser light impinging on the photo transistor 18 causes a current signal input to the microprocessor at line 31. The microprocessor then activates the visual display portion 8 of the target area, illuminating the G1–G4 and R1–R4 LEDs according to a second pattern, which flashes red in addition to green. Microprocessor 46 sends control signals to modules 47, 48 and 49 to activate the red and green LED circuits. The sound effects and flashing LED pattern increase in intensity, providing feedback that the laser has acquired the target area 5. When a player depresses or "fires" the joystick trigger 15 while on target, the trigger signal input over line 34 in combination with the photo transistor signal over line 31 input to the microprocessor causes activation of the target area. In response, the microprocessor causes a momentary sound to be emitted from the speaker 17 and a further increase in intensity of the red and green flashing pattern indicative of a "fire" sequence occurs, as shown in FIG. 11. Upon completion of the "fire" sequence, the microprocessor immediately transmits target control signals to modules 48 and 49 terminating the red and green LED pattern while transmitting activation signals to modules 50 and 51 to enable the target area to illuminate according to a third pattern of LEDs Y1–Y8 which flash yellow, as shown in FIG. 12. This flashing "explode" pattern is accompanied by a sound of descending frequency from speaker 17 indicative of an explosion. After a program-defined time delay of approximately 2.2 seconds, all flashing yellow LEDs are extinguished. The microprocessor 46 then retrieves from memory the relative target area position to determine if the just-activated target is the last target in the sequence. If it is not, then the microprocessor illuminates a series of green LEDs G1–G8 on strip board 4 positioned between the exploded target area and the next target area in the sequence to indicate the next target area at which to aim the laser diode. The microprocessor then stores the new target area position in memory as the current target area position, and the next target area is then illuminated according to the first green LED pattern, and the sequence is repeated as the player ascends to the top of the target display. The first player to activate and hence "explode" the last (i.e. top) target area in the sequence is the winner. In the case where the just-activated target area is the last target, (that is, when the microprocessor retrieves from memory the relative target area position number and determines that the just-activated target is the last target in the sequence) the microprocessor transmits control signals to modules 48–51 selectively enabling and disabling the red, green and yellow LEDs 8 according to the programmed pattern to execute the "win" pattern as shown in FIG. 13. The winning player's final target area is thus repeatedly illuminated with a multicolored pattern as in FIG. 13, while sound effects announce the win.

The winning player's microprocessor immediately samples line 36 for an active low win I/O signal. If the signal is high, the microprocessor 46 on that player's control board 42 changes its win I/O from an input to an output, thereby making the signal low. At this point, all other players' control board microprocessors, upon sampling their win I/O line 36, now detect an active low signal on the win I/O and go into a "lose" mode, wherein each microprocessor 46 deactivates its laser and disables player control, thereby preventing further game action. Each non-winning player's microprocessor then provides target control signals to module 48 to activate the green LED circuits for the currently enabled target area according to the first pattern stored in program memory. All other LED circuits are deactivated. No further signals are provided to the speaker 17 for any of the non-winning players. At this point, all laser diodes for all players are thus deactivated. All other player displays (except for the winning player) are silent and the last target enabled for each non-winning player is illuminated according to the first flashing green pattern. Depressing the start button returns the game to the silent display mode. At this point, the game is idle and ready for another play.

Figure 10:
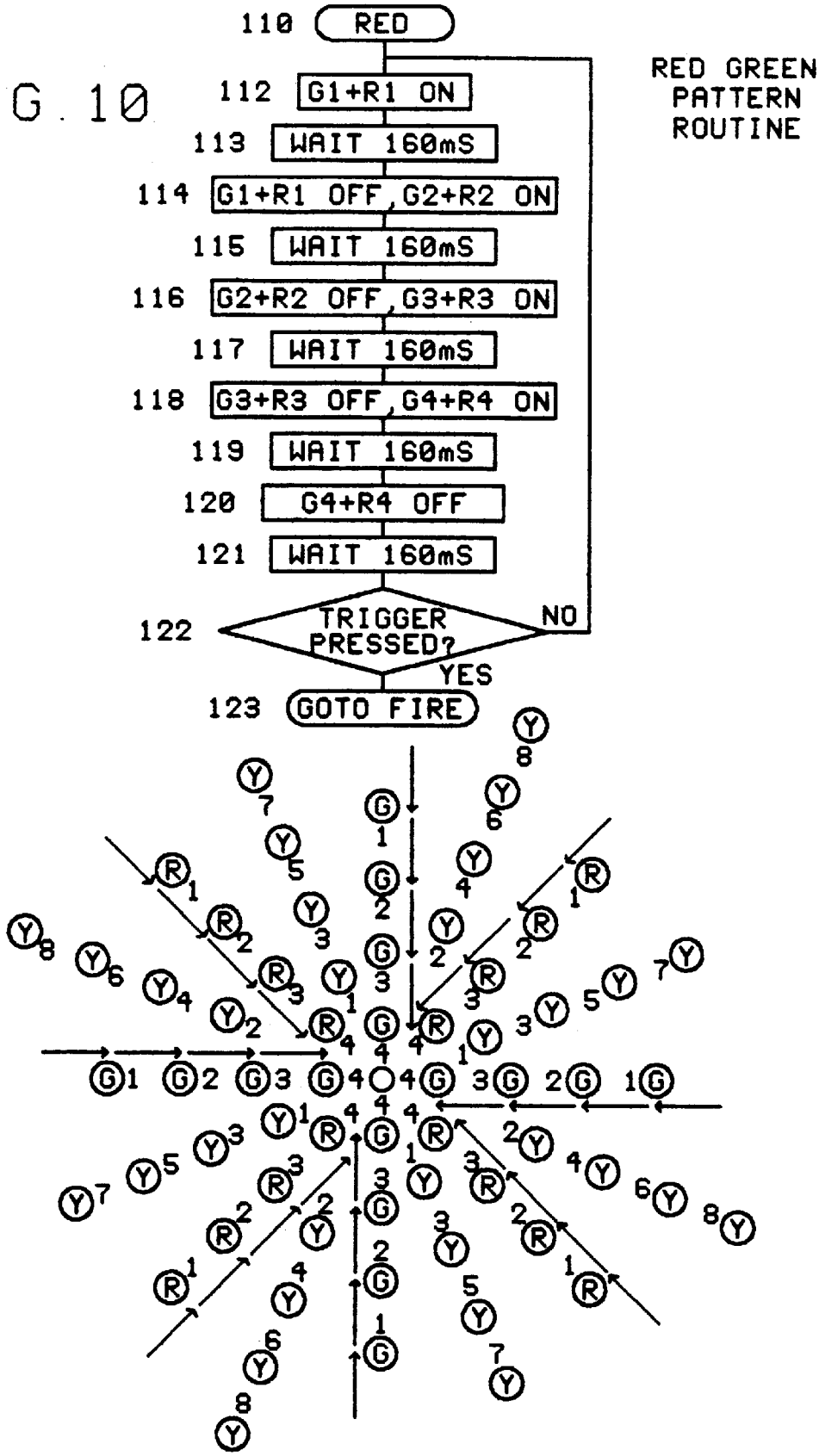
FIG. 10 is a flowchart and LED target pattern depicting a red/green illumination routine for the electronic racing game apparatus of the present invention.

The basic controller or microprocessor is controlled to operate according to the above description by separate programs stored in partitioned memory for quick retrieval and execution. For example, FIG. 9 illustrates the first green pattern routine for illuminating an enabled target area with flashing green LEDs G1–G4 to simulate a light pattern moving inwardly to the center of the target area. This pattern is initiated when a target area becomes enabled during play (i.e. "race") mode or after a winner has been determined. The steps labeled 90, 92, 94, 96, 98 show the sequential activation/deactivation of the G1–G4 LED circuits after a predetermined time interval of 200 msec. As can be seen from module 100, this routine is continuously repeated until the laser is aimed at the center of the enabled target area so that the photo transistor can detect the emitted light beam and notify the microprocessor. When this occurs, the microprocessor initiates execution of the second pattern (red and green) as indicated in module 110. FIG. 10 shows the routine for illuminating an enabled target area with flashing red and green LEDs G1–G4, R1–R4 to simulate the second inwardly moving light pattern. The steps labeled 112, 114, 116, 118, 120 show the sequential activation/deactivation of the G1,R1–G4,R4 LED circuits after a predetermined time interval of 160 msec. As is readily apparent, decreasing the wait time between LED activation/deactivation from pattern 1 to pattern 2 (from 200 msec to 160 msec) manifests an increase in the apparent motion of the moving lights to the viewer/participant, thereby providing further visual indication (in addition to the color change) that the laser has acquired the target. As can be seen from module 122, this routine is continuously repeated until the joystick trigger on the laser is depressed indicating a "fire," mode has been initiated to the microprocessor. When this occurs, the microprocessor initiates execution of the fire pattern (enhanced red and green) as indicated in module 123.

FIG. 11 shows the routine for illuminating the enabled target area according to the "fire" pattern with flashing red and green LEDs G1–G4, R1–R4. As in FIG. 10, The steps labeled 126, 128, 130, 132, 134 show the sequential activation/deactivation of the G1,R1–G4,R4 LED circuits in a stepped decreasing time interval (increasing frequency) fashion. Step 125 sets the initial activate/deactivate wait interval at 160 msec. Upon executing steps 126–135 to illuminate the LEDs according to the pattern, the microprocessor decrements the wait interval by 10 msec (step 136), stores the decremented wait interval in memory as the current wait interval, and then compares the current interval with a stored threshold interval of 30 msec (step 137) to determine if the current interval is less than the stored threshold. If the current interval equals or exceeds the threshold, the LED activation/deactivation sequence is repeated using the now current decreased wait interval, thus increasing the apparent motion of the lights. This routine is continuously repeated with the wait interval correspondingly decremented until the current wait interval is less than the threshold. At this point, the microprocessor initiates execution of a third "explode" pattern (yellow LEDs) as indicated in module 138.

FIG. 12 shows the routine for illuminating the enabled target area according to the "explode" pattern with flashing yellow LEDs Y1–Y8. The steps labeled 140–154 show the sequential activation of the Y1–Y8 LED circuits in a stepped fashion. A constant wait time interval of 120 msec. as shown in step 141 is provided between each activation. As can be seen, upon execution of step 55, all yellow LEDs (Y1–Y8) are illuminated. After a second wait interval (step 155) of 400 msec., each of the yellow LED circuits (Y1–Y8) are sequentially deactivated in ascending numeric order, as shown in steps 156–170. A constant wait time interval of 120 msec. as shown in step 157, is provided between each deactivation. Upon executing steps 140–171 to illuminate the LEDs according to this pattern, the microprocessor then compares the number of the current enabled target area with a stored number indicative of the last target in the sequence to determine if the current target area is the last target, as shown in module 172. If the current target area is not the last target in the sequence, the microprocessor selects the next target area in the sequence to be enabled and initiates execution of the first green pattern for that target area (steps 173–174). If the current target area is the last target in the sequence, the microprocessor executes the "win" routine for that target area.

FIG. 13 shows the routine for illuminating the target area according to the "win" pattern with flashing red, green and yellow LEDs. The steps labeled 176–185 show the sequential activation/deactivation of the G1–G4, R1–R4, Y1–Y8 LED circuits in a stepped fashion. A constant wait time interval of 50 msec. as shown in step 177 is provided between each activation/deactivation module. The microprocessor continuously executes steps 176–185 until an operator start signal is received as shown in module 186. When a start signal is received, microprocessor 186 is reset to silent display mode, as indicated in step 187, and awaits the operator enable signal to begin another play.

While there has been shown and described the preferred embodiments of the invention, other modifications and variations to the invention will be apparent to those skilled in the art from the foregoing disclosure and teachings. Thus, while only certain embodiments of the invention have been specifically described herein, it will be apparent that numerous modifications may be made thereto without departing from the spirit and scope of the invention.

What is claimed is:

1. An electronic game apparatus comprising a plurality of player positions wherein each contestant is assigned a given player position, each said player position having a target display, each said target display having an equal number of target areas on said display, wherein each said contestant proceeds from a first target area to a last target area, wherein said first contestant who activates all of said target areas in the shortest time interval wins, each said target area having a light sensitive portion and a visual display portion, said light sensitive portion responsive to a user-controlled light emitting means for aiming and firing a light beam at said light sensitive portion to activate said target, wherein said visual display portion is activated in response thereto to produce an illuminated pattern indicative of said target activation.

2. The apparatus according to claim 1, wherein said light emitting means includes a trigger operable to activate said target area by depressing said trigger when said light emitting means light beam impinges on said light sensitive portion of said target area.

3. The apparatus according to claim 2, further including controller means coupled to each said target area and to said light emitting means for controllably enabling each said light sensitive portion target area to be acquired and activated by said light emitting means during a race mode, wherein said target area is acquired by aiming said light emitting means onto said light sensitive portion of said target area.

4. The apparatus according to claim 3, wherein said visual display portion of each said target area includes a plurality of visual display indicators arranged in a predetermined pattern, said visual display indicators extending radially from a center of each said target area and operable to illuminate in response to said controller means.

5. The apparatus according to claim 4, wherein said controller means is operable to cause a first group of said visual display indicators to repetitively illuminate according to a first pattern indicative of said target area enablement, a second group of said indicators to repetitively illuminate according to a second pattern indicative of said target area acquisition, and a third group of said indicators to repetitively illuminate according to a third pattern indicative of said target area activation, wherein said controller means is operable to subsequently disable said target area after activation and enable said next target area in said sequence.

6. The apparatus according to claim 5, wherein said controller means further includes means for illuminating said display with a repetitive offset pattern during a non-racing mode to provide a visually appealing display pattern.

7. The apparatus according to claim 6, said controller means further including:

player enable means for selecting said race mode for a particular player position to cause said controller means to interrupt said non-race mode repetitive offset pattern for said particular player position and implement said target area control;

start means responsive to said race mode for permitting user-control of said light emitting means and enabling said first target area light sensitive portion to be acquired and activated by said user-controlled light emitting means.

8. The apparatus according to claim 7, said controller means further including means for terminating control of said player positions for all contestants and storing the results of a winner in response to said first contestant who activates said last target in said sequence.

9. The apparatus according to claim 5, wherein said radially aligned visual display indicators comprise red, yellow, and green light emitting diodes, wherein said first pattern comprises said radially aligned green LEDs repetitively illuminated and indicative of said pattern moving radially toward the center of said target, wherein said second pattern comprises said green and red LEDs repetitively illuminated and indicative of said pattern moving toward the center of said target, and wherein said third pattern comprises said yellow LEDs repetitively illuminated and indicative of said pattern moving radially from the center of said target.

10. The apparatus according to claim 1, further including sound means for generating sound effects associated with the operation of said game.

11. The apparatus according to claim 1, wherein said light emitting means includes a laser console having a laser diode and a backsplash, wherein said backsplash is operable to prevent contestant contact with said laser diode;

wherein said light sensitive portion of said target area is a photo transistor; and wherein said controller means includes a microprocessor.

12. The apparatus according to claim 11, wherein said laser diode is joystick-operated, and wherein said joystick is operable to limit the movement of said light beam to the area of said respective target display.

13. The apparatus according to claim 5, wherein said controller means is operable to cause said visual display indicators to display a win pattern responsive to said first contestant to activate all said target areas on said target display, wherein all other said contestant displays are disabled and said first pattern is displayed on said target area last enabled for each non-winning contestant.

14. A method of controlling an electronic target racing game having a plurality of player positions, each player position having a target display, said target display having a plurality of target areas, each said target area comprising a photosensitive portion and a plurality of visual display indicators, comprising the steps of:

illuminating said indicators to display a repetitive offset pattern indicative of a non-race mode;

stopping said repetitive offset pattern during the selection of a race mode and enabling a movable light emitting means for each said player position to aim a light beam at said target areas;

selectively enabling an at least one target area from said plurality of target areas to be activated by said light emitting means;

selectively enabling a next target area for activation when said previous target area is activated by said light emitting means;

determining which player position first activates all said target areas, defining a winner, by sampling a signal indicative of the end of the race;

selectively illuminating said indicators of said player position which first activates all said target areas according to a pattern indicative of a win.

15. The method according to claim 14, wherein said target area is activated by impinging said light beam from said light emitting means onto said photosensitive portion of said enabled target area while depressing a trigger on said light emitting means.

16. The method according to claim 15, further including the steps of:

selectively illuminating said visual display indicators of an enabled target area according to a first pattern indicative of said target area enablement;

selectively illuminating said visual display indicators of an enabled target area according to a second pattern indicative of the combination of said enablement and said light emitting means impinging on said photosensitive portion of said target area, defining a target area acquisition;

selectively illuminating said visual display indicators of an enabled target area according to a third pattern indicative said target area activation;

selectively generating sounds during said race mode, including sounds indicative of the start of said race, said target area acquisition, said target area activation, and said winner.

17. The method according to claim 14, further including the step of disabling all said light emitting means for all said player positions when said winner is determined.

18. The method according to claim 14, further including the step of resetting all said player positions to said non-race mode after said winner is determined.

19. The method according to claim 14, wherein the steps are implemented by programming a microprocessor.

20. The method according to claim 14, wherein said light emitting means includes a laser diode;

wherein said visual display indicators are light emitting diodes (LEDs);

wherein said photosensitive portion is a photo transistor;

wherein said plurality of target areas is six.

21. The method according to claim 14, further including the step of limiting the movement of said light emitting means to the target display area.

* * * * *